US009443489B2

(12) United States Patent
Liao et al.

(10) Patent No.: US 9,443,489 B2
(45) Date of Patent: Sep. 13, 2016

(54) GAMMA CURVE COMPENSATING METHOD, GAMMA CURVE COMPENSATING CIRCUIT AND DISPLAY SYSTEM USING THE SAME

(75) Inventors: Shang-Chia Liao, Hsin-Chu (TW); Yu-Hsi Ho, Hsin-Chu (TW); Yao-Jen Hsieh, Hsin-Chu (TW)

(73) Assignee: AU OPTRONICS CORP., Hsin-Chu (TW)

( * ) Notice: Subject to any disclaimer, the term of this patent is extended or adjusted under 35 U.S.C. 154(b) by 1670 days.

(21) Appl. No.: 12/370,730

(22) Filed: Feb. 13, 2009

(65) Prior Publication Data

US 2009/0267968 A1 Oct. 29, 2009

(30) Foreign Application Priority Data

Apr. 28, 2008 (TW) ..... 097115606 A

(51) Int. Cl.

| | |
|---|---|
| ***G09G 5/10*** | (2006.01) |
| ***G09G 3/36*** | (2006.01) |
| *G09G 3/20* | (2006.01) |
| *G09G 3/34* | (2006.01) |

(52) U.S. Cl.

CPC ..... *G09G 5/10* (2013.01); *G09G 3/3611* (2013.01); *G09G 3/2011* (2013.01); *G09G 3/3406* (2013.01); *G09G 2320/0673* (2013.01)

(58) Field of Classification Search

CPC .... G09G 5/10; G09G 3/3611; G09G 3/3406; G09G 2320/0673

USPC ..... 345/84–89, 211, 102, 590, 77

See application file for complete search history.

(56) References Cited

U.S. PATENT DOCUMENTS

| | | | | |
|---|---|---|---|---|
| 7,061,405 | B2 * | 6/2006 | Boyd et al. | 341/50 |
| 7,061,504 | B1 * | 6/2006 | Glen | 345/600 |
| 8,035,589 | B2 * | 10/2011 | Shiomi | 345/87 |
| 2002/0003522 | A1 * | 1/2002 | Baba et al. | 345/89 |
| 2004/0113906 | A1 * | 6/2004 | Lew et al. | 345/211 |
| 2004/0201562 | A1 * | 10/2004 | Funamoto et al. | 345/89 |
| 2005/0057484 | A1 * | 3/2005 | Diefenbaugh et al. | 345/102 |
| 2005/0184952 | A1 * | 8/2005 | Konno et al. | 345/102 |
| 2006/0119612 | A1 * | 6/2006 | Kerofsky et al. | 345/590 |
| 2006/0139270 | A1 * | 6/2006 | Hong et al. | 345/87 |
| 2006/0146005 | A1 * | 7/2006 | Baba et al. | 345/102 |
| 2007/0057959 | A1 * | 3/2007 | Cho et al. | 345/589 |
| 2007/0229447 | A1 * | 10/2007 | Takahara et al. | 345/102 |
| 2008/0068328 | A1 * | 3/2008 | Jou et al. | 345/102 |
| 2008/0074372 | A1 * | 3/2008 | Baba et al. | 345/89 |
| 2008/0100645 | A1 * | 5/2008 | Nitta | 345/690 |
| 2008/0238840 | A1 * | 10/2008 | Raman et al. | 345/84 |
| 2009/0002285 | A1 * | 1/2009 | Baba et al. | 345/77 |
| 2009/0015601 | A1 * | 1/2009 | Kim | 345/690 |

* cited by examiner

*Primary Examiner* — Lixi C Simpson

(74) *Attorney, Agent, or Firm* — WPAT, PC; Justin King

(57) ABSTRACT

An exemplary gamma curve compensating method is used in a displaying process of a display system for inserting a plurality of grey-scale images to adjust the displaying quality of the display system. A grey-scale luminance of each grey-scale image is one of the grey-scales. The gamma curve compensating method includes: providing a plurality of look-up tables (LUTs) according to the different grey-scales; selecting a specific grey-scale of the different grey-scales as a grey-scale luminance of one of the grey-scale images and accordingly selecting a specific LUT of the LUTs corresponding to the specific grey-scale; and performing a gamma-curve compensating based on the specific LUT to keep the gamma curve of the display system invariable in the displaying process. A gamma curve compensating circuit and a display system for performing the gamma curve compensating method are also provided in the present invention.

14 Claims, 5 Drawing Sheets

GAMMA CURVE COMPENSATING METHOD, GAMMA CURVE COMPENSATING CIRCUIT AND DISPLAY SYSTEM USING THE SAME

CROSS-REFERENCE TO RELATED APPLICATIONS

This application is based upon and claims the benefit of priority from the prior Taiwanese Patent Application No. 097115606, filed Apr. 28, 2008, the entire contents of which are incorporated herein by reference.

BACKGROUND OF THE INVENTION

1. Technical Field

The present invention relates to an image display technology, especially to a gamma curve compensating method, a gamma curve compensating circuit and an impulse-type driving display system using the same.

2. Description of the Related Art

At present, a typical method for eliminating or depressing motion blur phenomenon of liquid crystal displays (LCDs) is an impulse-type driving method, so call black insertion technology. However, in the impulse-type driving method, the black insertion technology can make the luminance of display screens of the LCDs decay, and cause an apparent flicker problem. In addition, a response time of the liquid crystal molecule of the LCD is not linear when a grey-scale applied thereto is increased from 0 to other level. If an original grey-scale applied thereto has a lower level, it needs to take more time for changing the original grey-scale to a destination grey-scale. Thus a ghost phenomenon is difficult to be eliminated.

In order to improve the above-described problems such as the luminance decay, flicker, or ghost phenomenon, a dynamic gray insertion technology is developed. The principle of the dynamic gray insertion technology is that a gray-scale to be inserted is determined according to different pictures.

However, in the process of inserting gray-scales, different gamma curves are achieved following insertion of different gray-scales. Thus, the situation of uneven brightness in a same picture, or even same color displaying different colors in different zones, is produced.

What is needed, therefore, is a gamma curve compensating method which is capable to overcome the above described problem.

SUMMARY OF THE INVENTION

In one aspect, an exemplary gamma curve compensating method is provided. The gamma curve compensating method is used in a displaying process of a display system for inserting a plurality of grey-scale images to adjust the displaying quality of the display system. A grey-scale luminance of each grey-scale image is one of the grey-scales. The grey-scale luminance of each grey-scale image is not completely same with each other. The gamma curve compensating method includes: providing a plurality of look-up tables (LUTs) corresponding to the different grey-scales; selecting a specific grey-scale from the grey-scales as a grey-scale luminance of one of the grey-scale images and accordingly selecting a specific LUT of the LUTs corresponding to the specific grey-scale; and performing a gamma-curve compensating based on the specific LUT to keep the gamma curve of the display system invariable in the displaying process.

In another aspect, an exemplary gamma curve compensating circuit used in a display system is provided. The gamma curve compensating circuit includes an image generating circuit, a grey-scale insertion determining circuit, a multiplexer, and a looking up and compensating circuit. The image generating circuit generates an original output image signal according to an input image signal received by the display system. The grey-scale insertion determining circuit determines a grey-scale luminance of a grey-scale image to be inserted according to the input image signal and output the grey-scale image. The multiplexer electrically couples to the grey-scale insertion determining circuit and the image generating circuit, and selects one of the grey-scale image and the original output image signal as an original display signal outputted therefrom. The looking up and compensating circuit electrically couples to the multiplexer for receiving the original display signal. The looking up and compensating circuit further provides a plurality of different LUTs, selects a specific LUT from the LUTs according to a grey-scale luminance of the grey-scale image, and performs a gamma-curve compensating on the original display signal based on the specific LUT.

Still in another aspect, an exemplary display system is provided. The display system includes a power supply, an image receiving terminal, a gamma curve compensating circuit, and a display screen. The power supply provides electric power to the display system for operating. The image receiving terminal receives an input image signal. The display screen displays a gamma-curve compensating result of the original output image signal generated by a gamma curve compensating circuit described as above.

Aforementioned embodiments of the present invention provide a plurality of LUTs according to the different grey-scales, select one specific grey-scale from the grey-scales to determine the luminance of one of the insertion grey-scale images in a displaying process, then select one specific LUT of the LUTs corresponding to the selected specific grey-scale, and perform gamma-curve compensating based on the specific LUT in order to adjust the gamma curve into a uniform standard gamma value, such as gamma 2.4. Therefore, the gamma curves of a display system can be kept to be invariable in the displaying process thereof, and then the display quality of the display system is improved.

Other objectives, features and advantages of the touch panel device will be further understood from the further technological features disclosed by the embodiments of display system wherein there are shown and described preferred embodiments of this touch panel device, simply by way of illustration of modes best suited to carry out the present invention.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION OF THE INVENTION

Figure 1:
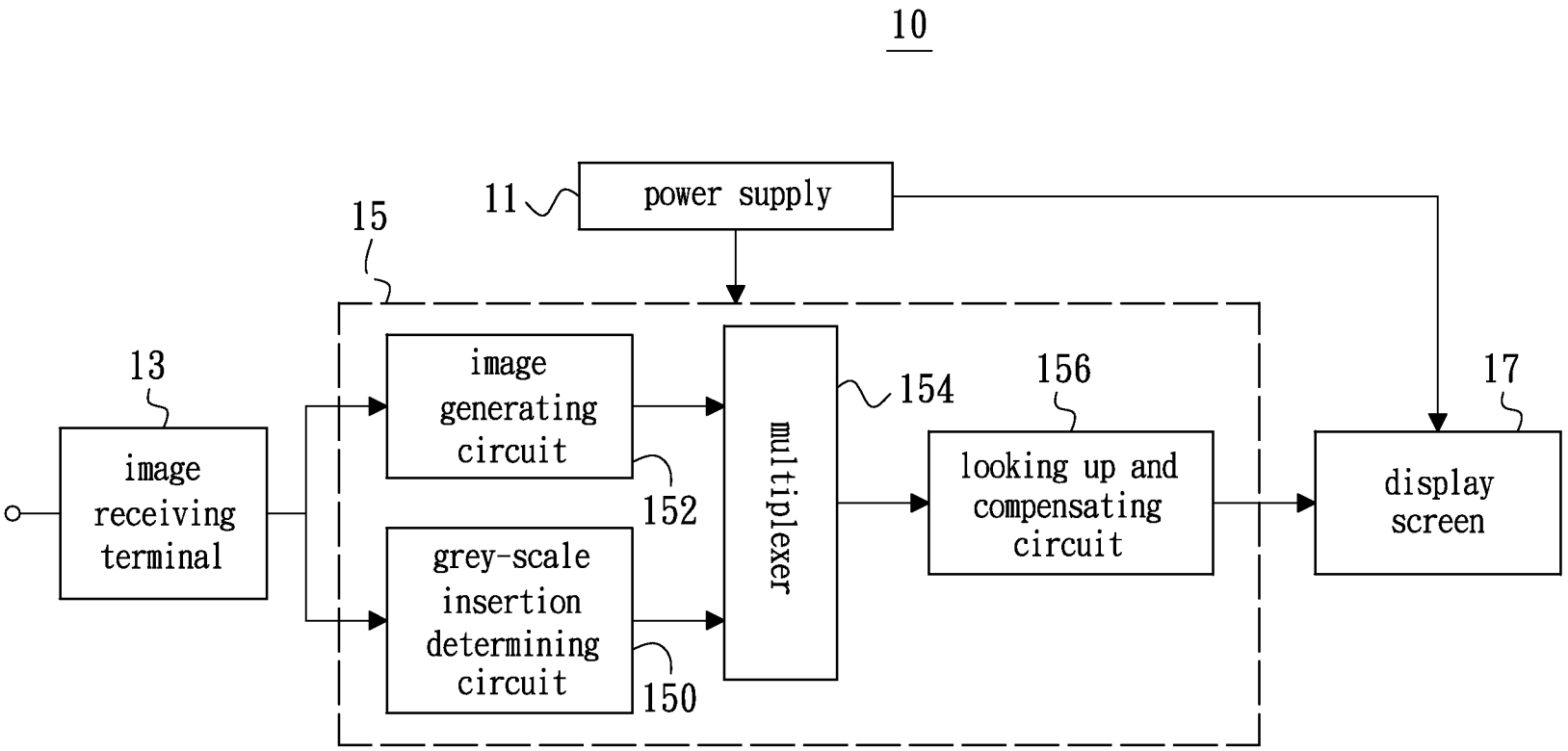
FIG. 1 is a circuit block diagram of a display system according to a first embodiment of the present invention, the display system including a grey-scale insertion determining circuit.

Reference will now be made in detail to the present preferred embodiments of the invention, examples of which are illustrated in the accompanying drawings. Wherever possible, the same reference numbers are used in the drawings and the description to refer to the same or like parts.

Referring to FIG. 1, a circuit block diagram of a display system according to a first embodiment of the present invention is shown. The display system 10 includes a power supply 11, an image receiving terminal 13, a gamma curve compensating circuit 15 and a display screen 17. The power supply 11 provides electric power to the display system 10 for operating. The image receiving terminal 13 receives input image signals. The display screen 17 is configured to display an image signal thereon.

The gamma curve compensating circuit 15 includes a grey-scale insertion determining circuit 150, an image generating circuit 152, a multiplexer 154, and a looking up and compensating circuit 156. The grey-scale insertion determining circuit 150 determines a grey-scale luminance of a grey-scale image to be inserted according to the received input image signal, and output the grey-scale image after the grey-scale luminance of the grey-scale image is determined. The image generating circuit 152 generates an original output image signal according to the received input image signals from the image receiving terminal 13. The multiplexer 154 electrically couples to the grey-scale insertion determining circuit 150 and the image generating circuit 152, selects the grey-scale image generated from the grey-scale insertion determining circuit 150 or the original output image signal generated from the image generating circuit 152 as an original display signal, and outputs the original display signal. The looking up and compensating circuit 156 electrically couples to the multiplexer 154 for receiving the original display signal. It is to be noticed that the looking up and compensating circuit 156 provides a plurality of different look-up tables (LUTs), selects a specific LUT from the different LUTs corresponding to grey-scale luminance of the inserted grey-scale image, and performs a gamma-curve compensating on the original display signal based on the specific LUT to keep the gamma curve of the display system 10 invariable in a displaying process. A gamma compensating result of the original output image signal by the looking up and compensating circuit 156 is displayed on the display screen 17.

Figure 2:
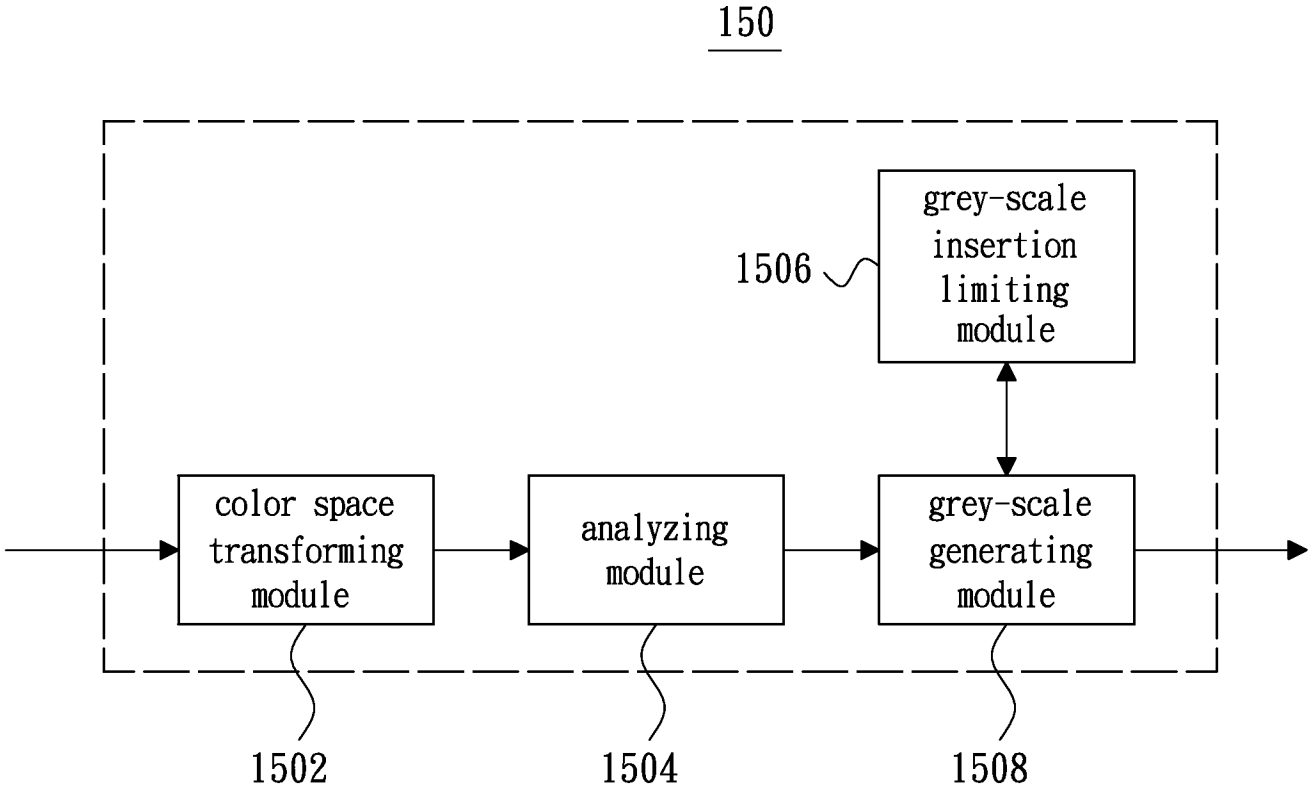
FIG. 2 is a circuit block diagram of the grey-scale insertion determining circuit of FIG. 1.

Referring also to FIG. 2, a circuit block diagram of the grey-scale insertion determining circuit 150 of the display system 10 is shown. The grey-scale insertion determining circuit 150 includes a color space transforming module 1502, an analyzing module 1504, a grey-scale insertion limiting module 1506 and a grey-scale generating module 1508. The color space transforming module 1502 transforms the input image signal received from the image receiving terminal 13 into a color space distributing data. The analyzing module 1504 electrically couples to the color space transforming module 1502 for receiving the color space distributing data. The analyzing module 1504 analyzes distribution of the color space distributing data and outputs a corresponding analyzing signal. The grey-scale insertion limiting module 1506 stores grey-scale limiting parameters. The grey-scale generating module 1508 electrically couples to the analyzing module 1504 and the grey-scale insertion limiting module 1506. The grey-scale generating module 1508 determines the grey-scale luminance of the grey-scale image to be inserted according to the analyzing signal generating from the analyzing module 1504 and the grey-scale limiting parameter retrieved from the grey-scale insertion limiting module 1506, and outputting the grey-scale image.

In detail, the grey-scale image to be inserted depends on a division as a unit. A same division is inserted grey-scale images with a same grey-scale. One division can be a line, a segment, a frame or several frames. The analyzing module 1504 can employ histogram analyzing method or other typical analyzing methods, such as minimum grey insertion method or threshold method et al., to determine a pre-inserting grey-scale of each division and employs the outputted analyzing signals to denote the pre-inserting grey-scale. The grey-scale of an image is generally divided into 255 levels, that is grey-scales L0~L255. In present embodiment, the grey-scale insertion limiting module 1506 can limit the range of the grey-scale to be inserted into a specific range, such as L0~L30. Regarding two adjacent divisions, the grey-scale insertion limiting module 1506 may limit a varying range of the grey-scales to be inserted, that is, a difference between the two levels of the grey-scales to be respectively inserted into the two adjacent divisions is less than a predetermined value, such as 5 or 10, or smooth the two adjacent divisions. Thus, the grey-scale generating module 1508 can achieve the final grey-scale of the grey-scale image to be inserted, that is grey-scale luminance, according to the pre-inserting grey-scale determined by the analyzing module 1504 matching with the grey-scale limiting parameters stored in the grey-scale insertion limiting module 1506, and output the grey-scale image with the final grey-scale.

Figure 3:
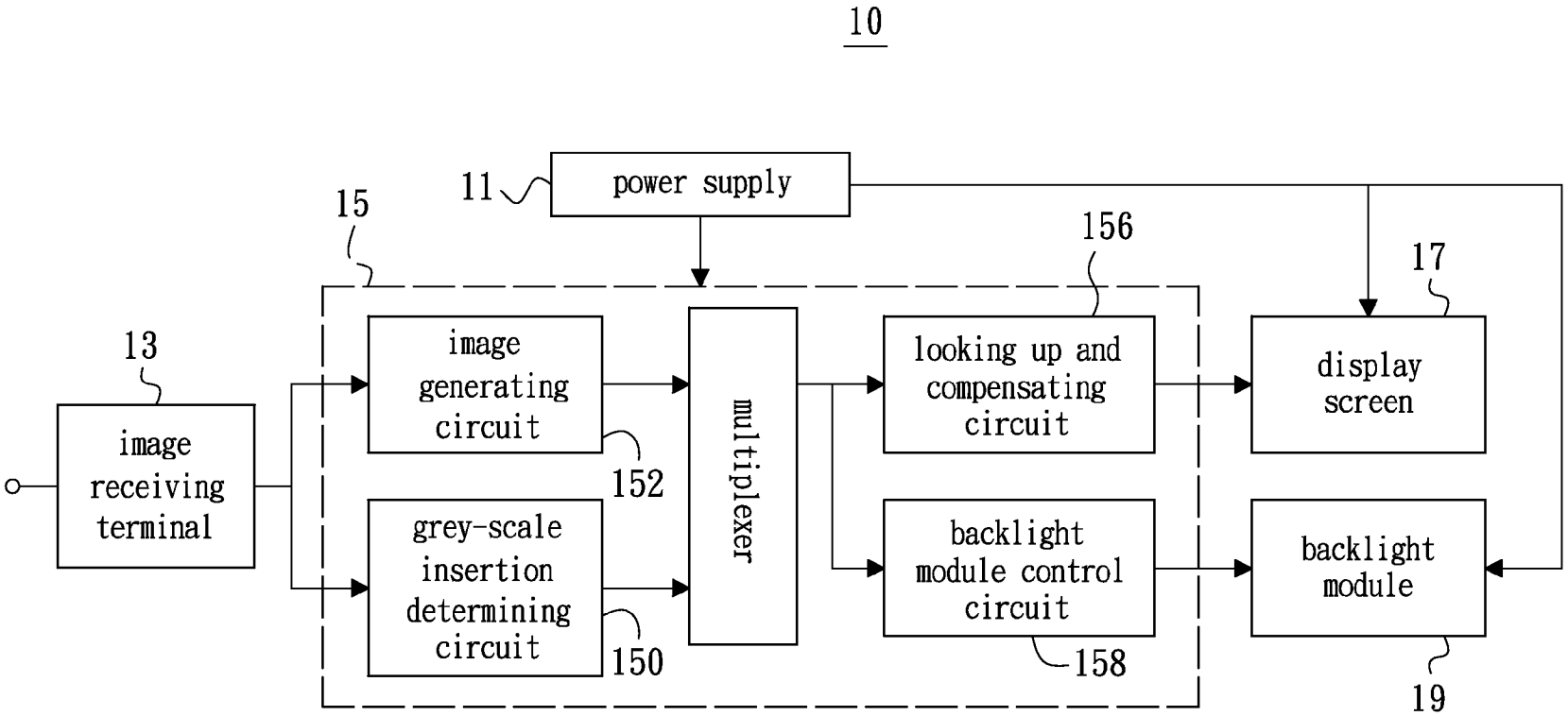
FIG. 3 is a circuit block diagram of a display system according to a second embodiment of the present invention.

Referring to FIG. 3, the display system 10 of the present embodiment can further include a backlight module 19 for providing backlight for the display screen 17. In this condition, the display system 10 can be a liquid crystal display device. In addition, the display system 10 can further include a backlight module control circuit 158. The backlight module control circuit 158 electrically couples to the multiplexer 154. The backlight module control circuit 158 controls a backlight module driving signal of the backlight module 19 so as to adjust luminance of a light source (such as backlight module 19) of the display system 10 according to the grey-scale luminance of the grey-scale image in the original display signal outputted from the multiplexer 154. Thus, in the displaying process of the display system 10, luminance of an image can be same after inserting different grey-scales matching with corresponding look-up tables. That is, the luminance of the display system 10 is invariable. The backlight module control circuit 158 can be incorporated into the gamma curve compensating circuit 15 as shown in FIG. 3. Alternatively, the backlight module control circuit 158 can be an independent circuit.

A gamma curve compensating method of the above described display system 10 is described in following. The display system 10 can adjust the displaying quality thereof by inserting a plurality of grey-scale images in the displaying process. A grey-scale luminance of one grey-scale image is one of the grey-scales. The grey-scale luminance of each grey-scale image is not completely same with each other. The gamma curve compensating method may include the following steps.

Step 1: providing a plurality of look-up tables (LUTs) corresponding to the different grey-scales. The LUTs might be provided by the looking up and compensating circuit 156 of the gamma curve compensating circuit 15.

Step 2: selecting a specific grey-scale of the different grey-scales as a grey-scale luminance of one of the grey-scale images, and accordingly selecting a specific LUT of the LUTs corresponding to the specific grey-scale by the looking up and compensating circuit 156.

Step 3: performing a gamma-curve compensating based on the specific LUT to keep the gamma curve of the display system 10 invariable in the displaying process. For example, the gamma curve of the display system 10 can be adjusted into a uniform standard gamma value, such as gamma 2.4.

Figure 4:
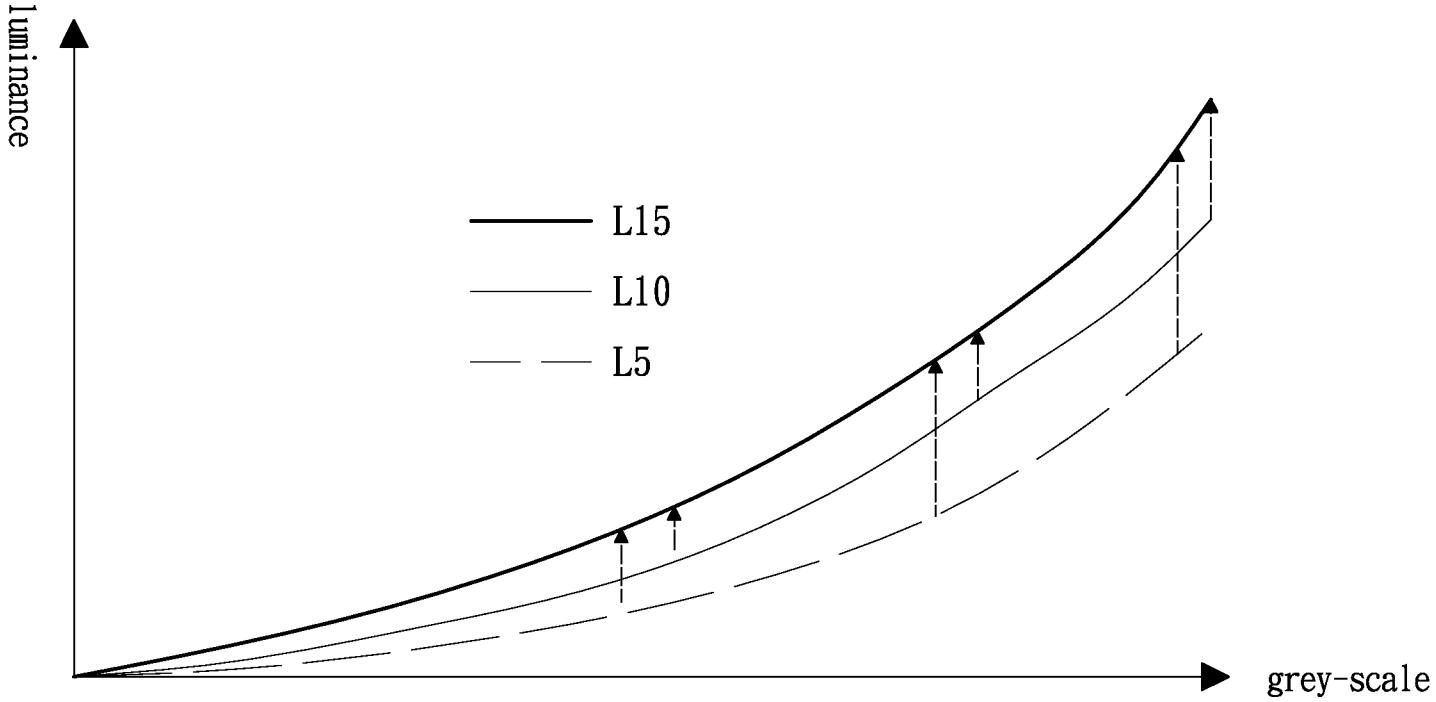
FIG. 4 is a curve chart showing a plurality of luminance curves corresponding to different grey-scales according to the first embodiment.

Referring to FIG. 4, although the gamma curve after inserting with different grey-scales can accord with a standard gamma value, such as gamma 2.4, it is still possible to exist difference between actual luminance of the inserted grey-scale images. Thus, the curve compensating method according to the present embodiment can further include a luminance correction step of adjusting the luminance of the light source of the display system 10 so as to keep the luminance of the display system 10 invariable in the displaying process. In detail, the correction of the luminance can be achieved by adjusting a driving signal for driving the light source (such as the backlight module 19) of the display system 10 via the backlight module control circuit 158. The driving signal to be adjusted can be a pulse width modulation (PWM) signal.

The inserted grey-scale having a higher level corresponds to a narrower pulse width of the PWM signal. A PWM signal with an appropriate pulse width is used to maintain a grey-scale luminance curve of a grey-scale image with a higher inserted grey-scale, such as grey-scale L15, without sacrificing the maximum luminance and increasing power consumption. A PWM signal with a wider pulse width is used to map upward a grey-scale luminance curve of a grey-scale image with a lower inserted grey-scale, such as grey-scale L10 and L5, as the dotted arrow shown in the FIG. 4. Thus, the grey-scale luminance curve and the gamma curve can both achieve a uniform result after inserting different grey-scales matching with the corresponding LUTs.

Figure 5:
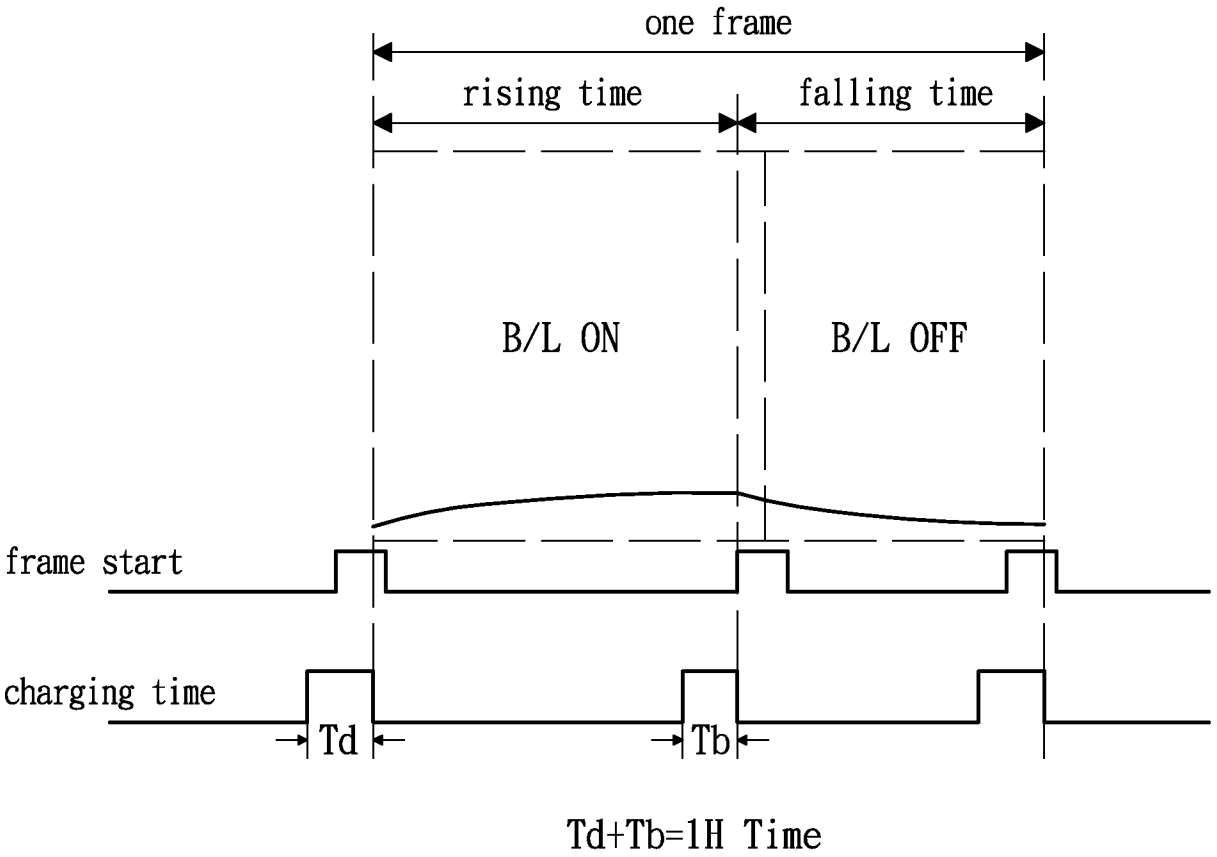
FIG. 5 is a wave diagram showing turning off the backlight at the beginning of a grey-scale insertion period of a frame as an image belongs to a low level grey-scale according to the first embodiment.

In addition, in a displaying process of inserting a plurality of grey-scale images, following increase of the luminance of the maximum grey-scale, the luminance of the minimum grey-scale is also increased, which results in a bad contrast of a picture in the displaying process of the display system 10. Therefore, as showing in FIG. 5, the gamma compensating method according to the present embodiment can further include a contrast increasing step of turning off the light source in a certain period of time to depress the increasing luminance of a grey-scale image having a low grey-scale level. In detail, if an image belongs to a low level grey-scale, at the beginning of a grey-scale insertion period of a frame, a backlight module driving signal of the backlight outputted from the backlight control circuit 158 is provided to turn off the backlight source (B/L OFF) so as to filer an unnecessary luminance of the grey-scale image having a low grey-scale and increase the contrast. B/L ON shown in FIG. 5 denotes that the backlight is in an alight state. Td and Tb denote a charging time of a display signal wherein a maximum value of Td adding Tb is equal to a frame of a horizontal scanning signal time (1H Time).

To sum up, the above described embodiments of the present invention provide a plurality of LUTs corresponding to the different grey-scales, select one specific grey-scale from the grey-scales to determine the luminance of one of the insertion grey-scale images in a displaying process, then select one specific LUT from the LUTs corresponding to the selected specific grey-scale, and perform gamma-curve compensating based on the specific LUT in order to adjust the gamma curve into a uniform standard gamma value, such as gamma 2.4. Therefore, the gamma curves of a display system can be kept to be invariable in the displaying process thereof, and then the display quality of the display system is improved. In addition, due to controlling the light source, a luminance of an image is corrected and an increasing of luminance of a grey-scale image with lower grey-scale is depressed to increase the whole contrast of the image. Thus, the displaying quality of the display system 10 is better.

The above description is given by way of example, and not limitation. Given the above disclosure, one skilled in the art could devise variations that are within the scope and spirit of the invention disclosed herein, including configurations of the circuit and/or designs of the gamma curve compensating method. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A gamma curve compensating circuit used in a display system, comprising:

an image generating circuit, generating an original output image signal according to an input image signal received by the display system;

a grey-scale insertion determining circuit, determining a plurality of grey-scale luminance of a grey-scale image to be inserted according to the input image signal and outputting the grey-scale image;

a multiplexer, having a first input terminal electrically coupled to the grey-scale insertion determining circuit and a second input terminal electrically coupled to the image generating circuit, and the multiplexer being used for providing an original display signal comprising the grey-scale image and the original output image signal; and a looking up and compensating circuit, electrically coupled to the multiplexer for receiving the original display signal, the looking up and compensating circuit providing a plurality of look-up tables, selecting a specific look-up table from the look-up tables according to the grey-scale luminance of the grey-scale image, and performing a gamma-curve compensating on the original display signal based on the specific look-up table;

wherein, the grey-scale image comprises a plurality of divisions, each one of the divisions corresponds to one of the plurality of grey-scale luminance, and the grey-scale luminance of each one of the divisions is determined according to the grey-scale luminance of another adjacent division of the plurality of divisions.

2. The gamma curve compensating circuit as claimed in claim 1, further comprising:

a backlight module control circuit, electrically coupled to the multiplexer and controlling a backlight module driving signal for driving a backlight module of the display system according to the grey-scale luminance of the original display signal outputted from the multiplexer.

3. The gamma curve compensating circuit as claimed in claim 1, wherein the grey-scale insertion determining circuit comprises:

a color space transforming module, transforming the input image signal received by the display system into a color space distributing data;

an analyzing module, electrically coupled to the color space transforming module for receiving the color space distributing data, and analyzing distribution of the color space distributing data to output a corresponding analyzing signal;

a grey-scale insertion limiting module, storing a grey-scale limiting parameter and limiting a varying range of the grey-scale luminance of two adjacent divisions; and a grey-scale generating module, electrically coupled to the analyzing module and the grey-scale insertion limiting module, determining the grey-scale luminance of the grey-scale image to be inserted according to the analyzing signal and the grey-scale limiting parameter, and outputting the grey-scale image.

4. The gamma curve compensating circuit as claimed in claim 1, wherein the display system comprises a liquid crystal display.

5. A display system comprising:

a power supply, providing electric power to the display system for operating;

an image receiving terminal, receiving an input image signal;

a gamma curve compensating circuit comprising:

an image generating circuit, generating an original output image signal according to the input image signal;

a grey-scale insertion determining circuit, determining a plurality of grey-scale luminance of a grey-scale image to be inserted according to the input image signal and outputting the grey-scale image;

a multiplexer, having a first input terminal electrically coupled to the grey-scale insertion determining circuit and a second input terminal electrically coupled to the image generating circuit, and the multiplexer being used for selecting one of the grey-scale image and the original output image signal as an original display signal; and a looking up and compensating circuit, electrically coupled to the multiplexer for receiving the original display signal, the looking up and compensating circuit providing a plurality of look-up tables, selecting a specific look-up table from the look-up tables according to the grey-scale luminance of the grey-scale image, and performing gamma-curve compensation on the original display signal based on the specific look-up table to generate a gamma compensating result; and a display screen, displaying the gamma compensating result;

wherein the grey-scale image comprises a plurality of divisions, each one of the divisions corresponds to one of the plurality of grey-scale luminance, and the grey-scale luminance of each one of the divisions is determined according to the grey-scale luminance of another adjacent division of the plurality of divisions.

6. The display system as claimed in claim 5, further comprising:

a backlight module, providing backlight for the display screen.

7. The display system as claimed in claim 6, further comprising:

a backlight module control circuit, electrically coupled to the multiplexer and controlling a backlight module driving signal for driving a backlight module according to the grey-scale luminance of the grey-scale image outputted from the multiplexer.

8. The display system as claimed in claim 5, wherein the grey-scale insertion determining circuit comprises:

a color space transforming module, transforming the input image signal received by the display system into a color space distributing data;

an analyzing module, electrically coupled to the color space transforming module for receiving the color space distributing data, and analyzing distribution of the color space distributing data to output a corresponding analyzing signal;

a grey-scale insertion limiting module, storing a grey-scale limiting parameter and limiting a varying range of the grey-scale luminance of two adjacent divisions; and a grey-scale generating module, electrically coupled to the analyzing module and the grey-scale insertion limiting module, determining the grey-scale luminance of the grey-scale image to be inserted according to the analyzing signal and the grey-scale limiting parameter, and outputting the determined grey-scale image.

9. A gamma curve compensating method, comprising:

selecting a plurality of grey-scales according to a grey-scale limiting parameter and an analyzing signal generated by an input image signal, and generating grey-scale images according to the generated grey-scales;

providing a plurality of look-up tables for the plurality of grey-scales;

selecting a plurality of specific grey-scales from the plurality of grey-scales of an inserted grey-scale image;

generating an original display signal according to the inserted grey-scale image and an original output image generated by the input image;

selecting, from the plurality of look-up tables, a specific look-up table corresponding to the specific grey-scale;

performing a gamma-curve compensation based on the specific look-up table to keep a gamma curve of a related display system invariable in a displaying process; and adjusting a light source of the display system to keep a luminance of the display system invariable in the displaying process;

wherein the grey-scale image comprises a plurality of divisions, each one of the divisions corresponds to one of the plurality of grey-scale luminance, and the grey-scale luminance of each one of the divisions is determined according to the grey-scale luminance of another adjacent division of the plurality of divisions.

10. The gamma curve compensating method as claimed in claim 9, further comprising:

turning off the light source of the display system in a certain period of time in the displaying process.

11. The gamma curve compensating method as claimed in claim 9, wherein the analyzing signal is to denote a pre-inserting grey-scale determined by a histogram analyzing method, a minimum grey insertion method or a threshold method.

12. The gamma curve compensating method as claimed in claim 9, wherein the grey-scale limiting parameter is used to limit a varying range of the grey-scale luminance of two adjacent divisions.

13. The gamma curve compensating method as claimed in claim 9, wherein the luminance of the display system is adjusted by a pulse width modulation signal, and the pulse width modulation signal with a wider pulse width is used to map upward a grey-scale luminance curve of the grey-scale image with a lower inserted grey-scale.

14. The gamma curve compensating method as claimed in claim 9, wherein each of the plurality of gray-scale images depends on a division as a unit, and each division is a line of image with a same grey-scale.

* * * * *